United States Patent [19]

Krückel et al.

[11] 4,230,655

[45] Oct. 28, 1980

[54] PENCILS

[75] Inventors: Peter Krückel, Nüremberg Gebersdorf; Wolfgang Winkler, Lauf, both of Fed. Rep. of Germany

[73] Assignee: Messrs. Schwan-Stabilo Schwanhausser GmbH & Co., Nüremberg, Fed. Rep. of Germany

[21] Appl. No.: 863,322

[22] Filed: Dec. 22, 1977

[30] Foreign Application Priority Data

Apr. 28, 1977 [DE] Fed. Rep. of Germany ..... 2718957

[51] Int. Cl.[2] ..... B29D 3/00

[52] U.S. Cl. ..... 264/135; 144/28; 144/309 J; 264/265; 264/267; 401/96; 425/DIG. 32

[58] Field of Search ..... 425/DIG. 32; 264/267, 264/265, 135; 144/28, 309 J; 401/96

[56] References Cited

U.S. PATENT DOCUMENTS

| | | | |
|---|---|---|---|
| 2,450,476 | 10/1948 | Harris | 144/28 |
| 2,753,991 | 7/1956 | Sherman | 264/267 |

FOREIGN PATENT DOCUMENTS

| | | | |
|---|---|---|---|
| 1503950 | 6/1969 | Fed. Rep. of Germany | 144/28 |
| 1408438 | 10/1975 | United Kingdom | 264/267 |

*Primary Examiner*—James H. Derrington

[57] ABSTRACT

A pencil, in particular for cosmetic purposes, is made by casting a stick composition into a tubular body, which forms the shaft of the pencil and is preferably seamless, in such a way that a ready-to-use exposed stick point is formed during casting.

The shaft may be of wood or plastics. In the case of a wooden shaft, a solid wooden rod of twice the shaft length may be bored out and otherwise worked and then separated along a central plane transverse to the axis of the rod to form a pair of shafts into which the stick composition can subsequently be cast.

7 Claims, 8 Drawing Figures

1

Figures 1, 2, 3, 4:
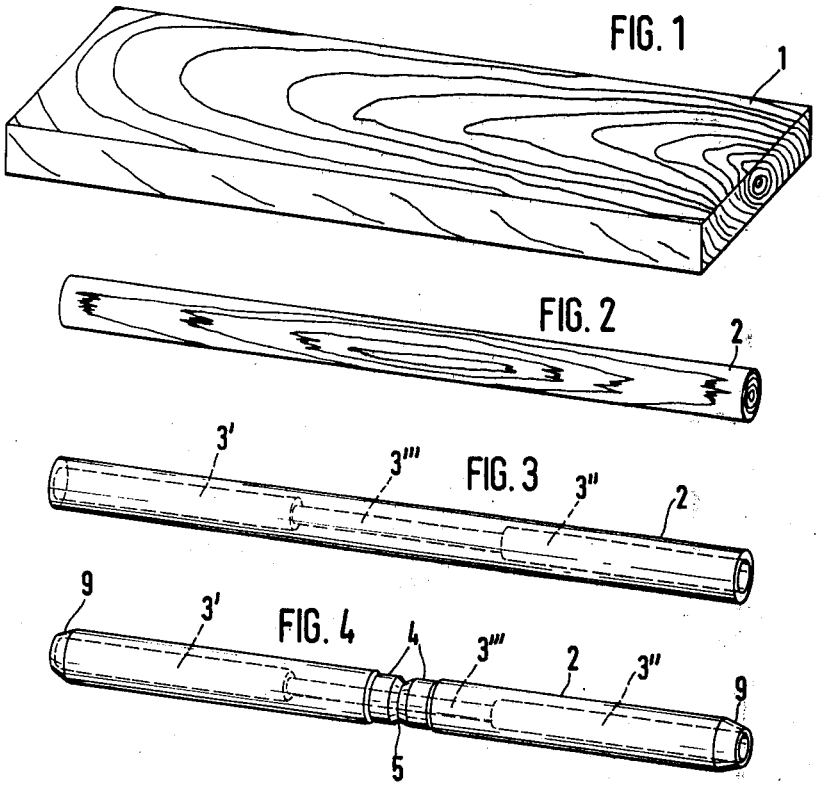

2
3'
3'''

3''
2
9
3'

4
3'''
2
3''
9
5

PENCILS

This invention relates to a pencil and to a method of making same and particularly but not exclusively to a pencil for cosmetic purposes, comprising a stick produced by a casting process and firmly enclosed by a shaft which is manufactured from a material which can be sharpened, for example wood or plastics.

Some known cosmetic pencils have a wooden shaft into which a prefabricated stick is inserted. In order that the stick can be inserted, the shaft is made up of two halves separated along an axial plane, which are glued to one another. In this way, the stick can be inserted between the longitudinal halves before the shaft is joined together. The manufacture of the longitudinal halves of the pencil shaft and the joining of these halves to one another, encasing the prefabricated stick, is well known from the manufacture of lead pencils (see, for example, German Auslegeschrift No. 1,953,985).

Pencils manufactured in the above way have a number of disadvantages which essentially are due to the manufacturing process. Since, with this process, the stick is initially entirely enclosed in the shaft, it is necessary to form the point of the stick in a separate operation, by machining of one end of the pencil body, so that the pencil can be supplied ready-to-use to the consumer. Machining leaves band-like traces or roughness on the stick point, and this can be troublesome in the case of cosmetic pencils, with which a particularly smooth surface of the stick point is desirable. A further disadvantage in use of such known pencils is to be seen in the fact that the end of the stick point becomes angular as a result of the machining while a rounded stick end would be desirable for application using a cosmetic pencil.

During the machining of a pencil to expose the stick point, the end of the shaft is so bevelled that the close contact between the weakened wall of the shaft and the stick can be lost. Frequently, bending-up of the bevelled end of the shaft can arise and this detracts from the usefulness and appearance of the pencil. Furthermore, the blade used for sharpening the shaft at the end imposes a dynamic stress on the stick, so that the stick must have a certain minimum strength but this is counter to the aim of imparting to the stick a consistency (soft or plastic) necessary for optimum application in use of the stick material.

Furthermore, in the manufacture of known cosmetic pencils, when lettering or decoration is applied to the outer surface of the pencil casing, the structure, and thus the strength of the stick, are impaired by the relatively high pressure employed during the application process. Afterwards the stick tends to break on sharpening. In cosmetic pencils, the stick consists of a soft, waxy composition and obtains its strength on transistion from the molten to the solid phase by the cooling process. It is therefore particularly sensitive to cold deformation. Such impairment of the structure of the stick also leads to a reduction in the delivery capacity of the stick.

Finally, in the case of known cosmetic pencils having a shaft consisting of a material or wood which can be sharpened, a disadvantage from the hygiene point of view is also of importance. This is because it is impossible, or is possible only with difficulty, to manufacture the stick, and to insert it into the shaft, without contamination.

According to a first aspect of the invention, there is provided a pencil comprising a stick and firmly enclosed by a hollow tubular shaft of a material which can be sharpened, the stick having an exposed point at one end thereof, the stick including said point having been cast into said tubular shaft.

Since the exposed stick point is shaped by casting, the desired shape is imparted to the point during casting of the stick. In this way, the flattening or angled shaping which arises at the end of the stick point as a result of sharpening during the production of the known pencil can also be avoided. In a preferred embodiment of the invention, the end of the stick point, which is preferably formed in the shape of a cone, is rounded off to a convex shape, so that a smooth and relatively large application surface is obtained; this is especially desirable for lipsticks.

A flush, that is to say smooth, transition from the peripheral surface of the stick point to the outer surface of the shaft can be achieved by appropriate matching of the casting space in a mould, in which the stick point is cast to that end of the tubular shaft body which adjoins the stick point and is introduced into the casting space of the mould. For this purpose, the one end of the shaft can be provided with an outer surface in the shape of a truncated cone, that is to say a surface tapering towards the end face of the shaft, this outer surface joining the outer surface of the preferably dome-shaped stick point without a ridge.

In order to avoid the bending up of the bevelled end of the shaft which is frequently observed in the case of known cosmetic pencils, it is possible to form a small projecting shoulder on the point of the stick at the transition from the shaft to the stick point, with a blunt annular end face of the shaft resting on this shoulder and the radial extent of the shoulder of the stick point corresponding to the width of the end face of the shaft.

The tubular body which is the shaft may for example, be of wood or plastic. In the latter case it is appropriate to mould ribs running parallel to the axis and/or circumferentially (annular ribs) on the inside of the plastic tubular body. These ribs are embedded in the stick composition when this is cast and thus prevent the stick composition, after this has solidified, from being able to shift radially and/or axially relative to the tubular body. This can be of importance because of the forces acting on the stick during sharpening of the pencil.

If the shaft is wooden, the wood used for the shaft of the pencil can be such as is used in the manufacture of conventional lead pencils (for example cedarwood). If plastics is used in place of wood it must, of course, be possible to machine this plastics with a sharpener. Examples of plastics of this type which may be mentioned are polyvinyl chloride, polypropylene and acrylonitrile/butadiene/polystyrene copolymers.

The manufacture of the pencil can be carried out in such a way that the bacterial infection of the stick during the manufacture of the pencil can be reduced to a minimum and contamination is thus substantially avoided.

Various manufacturing processes can be used for making the pencil, depending on whether wood or plastic is used as the material for the shaft. Methods of making a pencil embodying the invention and having a wooden shaft will be described below.

In the first embodiment, a solid rod having a length and external cross-section corresponding to those of the shaft is first produced in a manner which is in itself known from a wooden board of appropriate thickness. Any desired working of the outer surface of the pencil shaft is carried out on this solid rod. Working of the outer surface is to be understood as meaning, in particular, all the measures (for example, polishing, imprinting) in which a radial pressure is exerted on the solid rod, as is the case, for example, of applying markings or decorations. The rod is then bored out throughout its length in accordance with the desired thickness of the stick, which can vary over the length of the pencil. The outside of the front end, that is to say the end subsequently adjacent to the stick point, of the bored-out rod is then turned to a truncated cone in such a way that, when this end is subsequently inserted into a casting mould used to form the stick point, a casting space corresponding to the desired shape of the stick point remains free. It is, of course, also possible to carry out the turning even on the solid rod, that is to say before boring out. The front end of the pencil shaft which is now complete, is inserted into a casting mould and subsequently the shaft interior is filled with molten stick composition from the rear open end of the shaft, so that the stick point can form in the casting space of the mould and the bore of the shaft is also filled completely with stick-casting composition. After the stick composition has cooled, the pencil can be removed from the mould and then passed to a final assembly unit where an end cap is fitted tightly onto the rear end of the pencil and a protective cap is pushed onto the front end.

With regard to the fixing of a tightly fitting end cap onto the pencil, it is possible first to produce a solid rod having a length corresponding to twice that of the shaft, after which, in order to prepare the subsequent seating face of the end cap with the object of providing a flush transition from the outer surface of the cap to the outer surface of the cap to the outer surface of the pencil shaft and an annular groove is then turned in the central region of the rod symmetrically to a central plane running perpendicularly to the longitudinal axis of the rod, in order to reduce the external cross-section of the shaft. The rod is bored out uniformly from both ends so that the bore has a smaller cross-section in the region of the annular groove than in the remaining region and, after turning the ends of the rod, this is separated along the central plane.

Within limits, the sequence of the individual method steps can be varied. Thus, it is possible to apply the decoration to the outer surface of the rod, to form the abovementioned annular groove and to turn the end of the rod to a truncated cone before or after the bore is formed or before or after the rod is separated. However, it appears to be most appropriate to carry out the working on the outer surface of the rod before this is bored out. The rod still has a greater strength at this time than after boring out and is thus better able to absorb the effects of the pressure which arise during working than is a hollow rod.

The end faces of the annular groove produced on the rod form a shoulder on the outer surface of the shaft, and the end face of the end cap pushed onto the rear end of the shaft rests on this shoulder.

If the pencil shaft consists of plastics, the method used can be as follows. A tube having a length and external cross-section corresponding to those of the shaft is first produced with, at its front end, that is to say the end adjacent to the stick point, an outer surface in the form of a truncated cone such that, when this end is subsequently inserted into the casting mould used to form the stick point, a casting space corresponding to the desired shape of the stick point remains free. The outer surface of the tube is then worked if desired and subsequently the front end of the tube is inserted into the casting mould and the molten stick composition is then cast into the tube from the rear end thereof. With this method it is, of course, possible to take measures corresponding to those in the method described, which starts from a wooden rod, for pushing on an end cap. However, the reduction in the external cross-section of the pencil shaft would already be allowed for by appropriate shaping of the tube during manufacture of the plastics tube, which is effected by the known processing methods for plastics. In general, the tube for the manufacture of the pencil shaft can be manufactured by an injection-moulding process.

Whether a wood or plastics pencil casing is manufactured by one of the methods described above, these methods have the advantage that the stick can suffer no impairment during the individual processing and working steps for the pencil shaft because the stick is introduced into, or produced in, the shaft only after the production of the shaft of the pencil is complete. This eliminates the disadvantage to which the known manufacture of a pencil is subject, that is to say that the stick composition, which is relatively sensitive to deformation in the cold, is also subjected to the forces (pressures) acting on the pencil shaft during working thereof. A further advantage which can be achieved by means of embodiments of the invention is to be seen in the fact that it provides the pre-requisites for bacteria-free production of cosmetic pencils.

Before casting the stick composition in the hollow shaft it can be appropriate to line the walls of the bore with a fat-resistant thin insulating layer, for example a wax-repellent lacquer coating, so that constituents of the stick composition cannot migrate into the shaft. This is important in particular when a hollow shaft made of wood is used.

The invention can be employed for the manufacture of cosmetic pencils, such as lipsticks, eye shadow pencils, eyebrow pencils and pencils for applying rouge. There are also applications in fields closely connected to the cosmetics industry, for example the manufacture of perfume pencils, deodorant pencils and coolant pencils. However, the invention can also be used for the manufacture of stick pencils outside the cosmetics industry. Adhesive pencils, that is to say pencils in which the stick releases an adhesive composition on application, may be mentioned as an example of these.

A second aspect of the invention provides a method of making a pencil comprising casting material which is to form the stick of the pencil into a hollow tubular shaft which is to form the shaft of the material, a point of the stick which is free of the shaft being formed during said casting step.

The invention will be further described below with reference to the accompanying drawings, in which:

FIGS. 1 to 8 illustrate the working steps which can be carried out in one embodiment of the method of making a pencil according to the invention and which follow one another in the sequence of the Figures.

If a pencil having a wooden shaft is to be produced, solid round rods 2, as shown in FIG. 2, can be produced from the wooden board 1, (FIG. 1) by working methods known from the wood machining arts. Before these rods are now bored out from their ends (FIG. 3), the peripheral surface of the round rods 2 can be worked, for example polished, stamped or printed, the surface working in a particular case depending on the appearance, of the outer surface of the shaft, which is desired for the finished pencil.

The process illustrated in FIGS. 1 to 4 starts from a length of round rods 2 which corresponds to twice the length of the shaft of the pencil to be manufactured.

Figure 5:
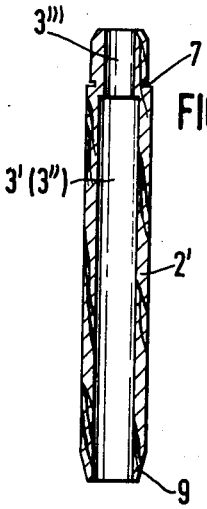

After the surface working, the round rods are bored out at their ends, leaving in the case of the illustrated embodiment, a section 3''' of bore having a diameter smaller than that of sections 3' and 3'' interconnecting the sections 3' and 3'' of the bore extending from the ends of the rod. The reason for this can be seen from FIG. 4, in which the central region of the hollow rod obtained in the working step according to FIG. 3 is provided with an annular groove 4 by turning, this groove, in turn, having in its centre a turned notch-like recess 5 which facilitates separation of the hollow rod 2 into two parts, each as shown in FIG. 5. By stepping the bore, which extends the entire length of the hollow rod 2, with the central region 3''', which has a smaller diameter, a wall thickness which is adequate for the desired strength in this region is retained despite the turned recesses 4 and 5.

The turned recess in the hollow shaft 2 beyond the groove 4 leads to the formation of a shoulder 7 on the part 2' of each of the hollow bodies which are obtained after separation in the region of the turned recess 5. The decorative cap 8 fitted on the rear end of the part 2' in a subsequent working step rests on this shoulder, the transition from the outer surface of this cap to the outer surface of the part of the hollow body 2' containing the section 3' or 3'' of the bore being ridgeless (compare FIG. 7).

Figure 6:
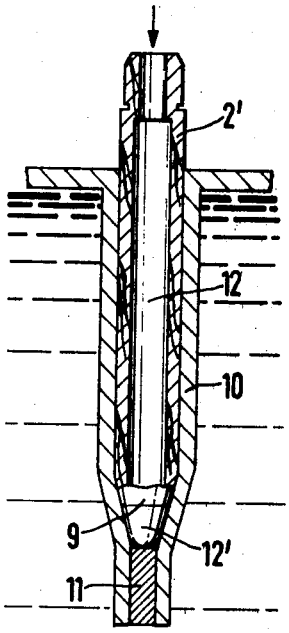

Before the hollow rod 2 shown in FIG. 4 is separated, the ends thereof are worked, for example by milling, in such a way that end sections 9 each in the shape of a truncated cone result. FIG. 6 clearly illustrates that the tapering of the end sections 9 is matched to the shape of the casting mould 10 and specifically is matched in such a way that a casting space for the formation of an exposed point 12' of the stick generally designated 12, that is to say a point which is not covered by the part 2', remains between the end of the tubular body 2' which is introduced into the casting mould and the ejector 11 which closes the mould at the bottom.

It should also be mentioned that it is possible, before separating the round rod 2, also to provide the inner wall thereof with a coating (insulation), for example of a wax-repellent lacquer, so that the composition of the stick 12 subsequently introduced into the tubular body 2' cannot penetrate into the wall of the tubular body.

If the shaft of the stick pencil is to consist of a plastic which can be sharpened, the working steps of FIGS. 1 and 4 are, of course, omitted and a tubular body corresponding to the shape according to FIG. 5 is manufactured straightaway by a processing method for plastics which is customary for this purpose (for example an injection-moulding process). With regard to the working steps according to FIGS. 5 to 8, there is thus no difference between the manufacture of a pencil having a wooden shaft and that of a pencil having a plastics shaft.

The tubular body 2' which forms the pencil shaft is inserted into the casting mould 10, as can be seen from FIG. 6, after which the liquid (molten) composition for forming the stick 12 is then cast into the rear end of the tubular body, which projects from the mould. It is not absolutely essential completely to fill the entire inner space of the shaft 2' with the stick composition. The filling level will depend on the length to which, according to expectation, the consumer will sharpen the pencil.

After the stick composition has cooled and solidified, the pencil is pushed out of the mould 10 by means of the ejector 11.

Figure 7:
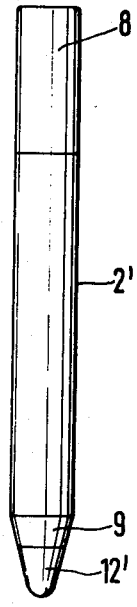
Figure 8:
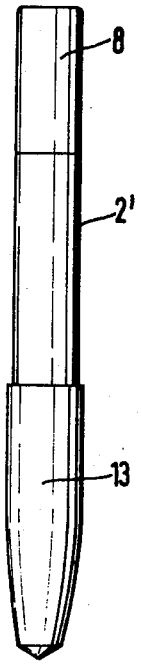

The decorative cap 8 is then pushed onto the rear end and the protective cap 13 is pushed onto the front end (compare FIGS. 7 and 8).

By appropriate shaping of the casting space for the formation of the stick point 12', it is possible to adapt the shape of this point to the character or the use of the pencil.

We claim:

1. A method of making a pencil for cosmetic purposes that can be sharpened, comprising the steps of: preparing a tubular wooden shaft with an axial through-bore, coating the bore with a material, placing said shaft into a mold extending beyond one end of said axial through-bore, and casting a cosmetic stick composition into said bore from the other end of said through-bore so as to fill the space beyond said one end to form a point, said coating being made from a material adapted to counter penetration of said wooden shaft by said cosmetic composition.

2. A method according to claim 1, wherein said step of preparing said shaft includes shaping the end of said shaft at said one end of said bore to form a truncated cone so that in said mold a casting space remains.

3. A method according to claim 1, comprising selecting a rod having a length twice that of the shaft of the pencil to be produced, preparing a seating surface for an end cap for the finished pencil and a flush transition from the outer surface of the cap to the outer surface of the pencil shaft by turning an annular groove in the central region of the rod symmetrically to a central plane running perpendicularly to the longitudinal axis of the rod, boring the rod out uniformly from both ends so that the bore has a smaller cross-section in the region of the annular groove than in the remaining region, and separating the rod along the central plane to form the pencil shaft.

4. The method according to claim 1, wherein said point is rounded off to a convex shape.

5. The method according to claim 1, wherein there is a flush transition from the peripheral surface of the stick point to the outer surface of the shaft.

6. The method according to claim 2, wherein the end of the shaft adjacent to the stick point merges with the outer surface of the stick point via a frusto-conical outer surface.

7. The method according to claim 2, wherein at the transition from the shaft to the stick point, the latter has a small projecting shoulder, a blunt annular end face of the shaft resting on the shoulder and the extent of the shoulder radially of the stick corresponding to the width of said end face of the shaft.

* * * * *